US007557771B1

(12) United States Patent
Hodges

(10) Patent No.: US 7,557,771 B1
(45) Date of Patent: Jul. 7, 2009

(54) WALL-MOUNTED ANTENNA RAIL MAST SYSTEM

(76) Inventor: Donald T. Hodges, 3700 Woodland Dr., Ste 100, Anchorage, AK (US) 99517

( * ) Notice: Subject to any disclaimer, the term of this patent is extended or adjusted under 35 U.S.C. 154(b) by 19 days.

(21) Appl. No.: 11/978,054

(22) Filed: Oct. 26, 2007

(51) Int. Cl.
*H01Q 1/12* (2006.01)

(52) U.S. Cl. ..... 343/891; 343/878

(58) Field of Classification Search ..... 343/890, 343/891, 878
See application file for complete search history.

(56) References Cited

U.S. PATENT DOCUMENTS 5,961,092 A * 10/1999 Coffield ..... 248/539
6,731,250 B1 * 5/2004 Berman ..... 343/878
6,808,151 B1 * 10/2004 McLaughlin et al. ..... 248/354.1

* cited by examiner

*Primary Examiner*—Don P Le
(74) *Attorney, Agent, or Firm*—Michael Tavella

(57) ABSTRACT

A lightweight rail that is bolted to the existing structure using standoff brackets. A carrier is attached to the rail to support the antenna. Once the rail and carrier are installed, access to an antenna is from the base of the rail. The rail is made of square aluminum tubing and the carrier is made of aluminum plate. In the lowered position, the carrier is readily accessible and the antenna mast can be tipped down to a horizontal position to access the antenna. The carrier and antenna are lifted using a hand winch, although a motor can be used as well. A simple cable system is used to hoist the carrier into the operable position at the top of the rail. Overall, the system is lightweight, low cost and safe to use.

19 Claims, 12 Drawing Sheets

WALL-MOUNTED ANTENNA RAIL MAST SYSTEM

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to antenna masts and particularly to wall mounted antenna masts.

2. Description of the Prior Art

Today, communications forms the backbone of the modern world. To handle this volume of communication today, many antennas are required. These antennas are typically installed atop towers, on buildings, in fields, adjacent to highways, etc. Often these towers are quite high running 100 feet and higher. To install these antennas, some foundation structure is needed for towers. Antennas on buildings also generally use towers that are attached to the roof of a building. In all of these cases, maintaining the antennas requires that workers must climb the towers to access the antenna. This dangerous job requires workers to carry tools and equipment one hundred feet or more into the air while climbing a narrow ladder. Therefore, there is a need for a better system for supporting antennas that provides easy access to the antenna for maintenance.

BRIEF DESCRIPTION OF THE INVENTION

The instant invention overcomes the problems mentioned above. It is a rail mast that uses a carrier to hold antennas that can be accessed from the ground, but can extend up to 150 feet above the access level. Moreover, with this system there is no need for a foundation that must be built for the installation of the system. Any existing building, open structure or pole can be used to support the antenna.

The system uses a lightweight rail that is bolted to the existing structure using standoff brackets. Once the rail is installed, access to the antenna is from the base of the rail. A carrier is attached to the rail to support the antenna. The rail is made of square aluminum tubing and the carrier is made of aluminum plate. Low-friction plastic pads are installed between the carrier and the rail.

In the lowered position, the carrier is readily accessible and the antenna mast can be tipped down to a horizontal position to access the antenna or other electronic components. The carrier, with the antenna attached, is lifted using a hand winch, although a motor can be used as well. The carrier has clamps and a ratchet mechanism to control the movement of the carrier on the rail. A simple cable system is used to hoist the carrier into the operable position at the top of the rail. Overall, the system is lightweight, low cost and safe to use.

DETAILED DESCRIPTION OF THE INVENTION

Figure 1:
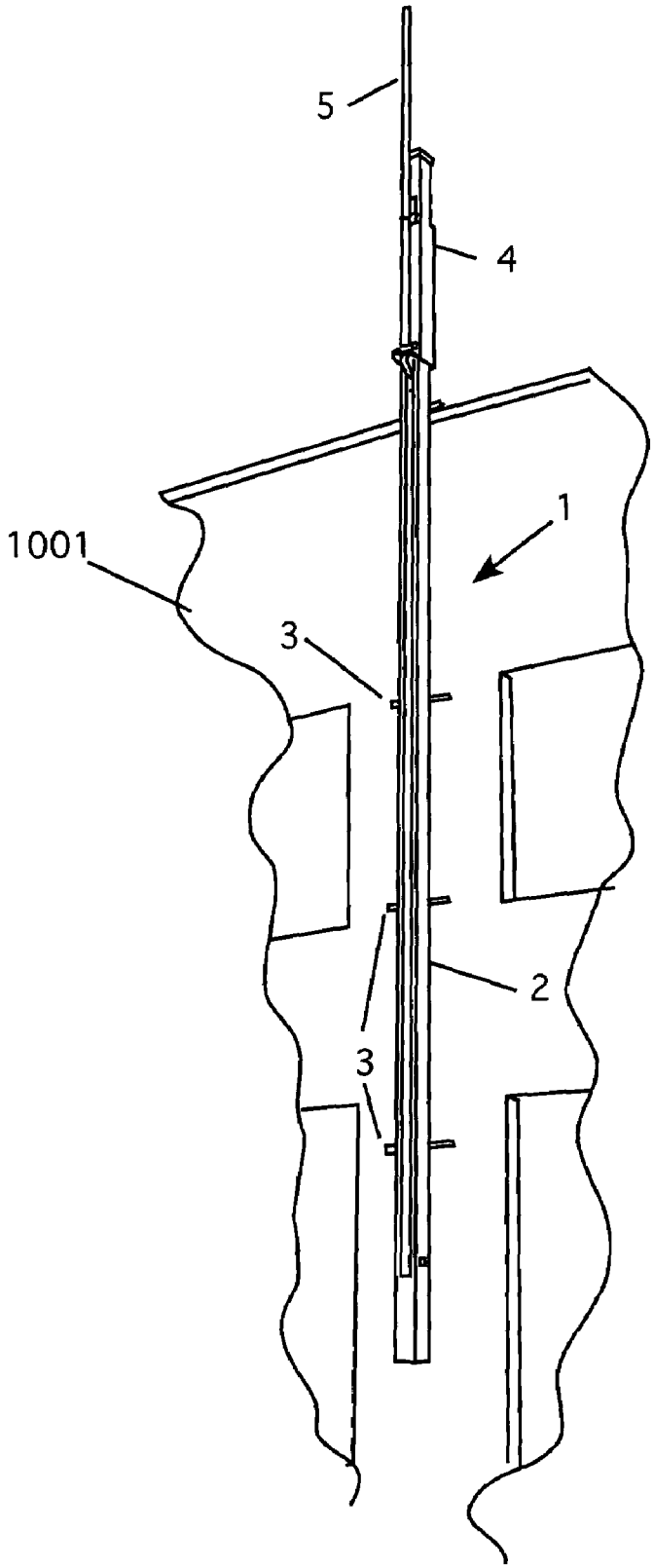
FIG. 1 is a perspective view of the invention, mounted on a building, with the antenna carrier raised.

Referring now to FIG. 1, a perspective view of the invention 1, mounted on a building 1001, with the antenna carrier raised, is shown. The invention 1 is attached to a building, post, tower, or other structure that has a large enough profile to hold the rail. The advantage of the system is two fold. First, because it attaches to an existing structure, no additional excavation and construction for a foundation and antenna support structure beyond the rail system is necessary. Second, the use of the system eliminates the need for workers to have to climb a structure to access an antenna for service.

As show in FIG. 1, the rail 2 is secured to the building wall using brackets 3, which are discussed below, at regular intervals. A carrier 4 is attached to the rail, as discussed below. The carrier rides along the rail and is raised and lowered by a winch system, also discussed below. An antenna mast 5 is attached to the carrier and is held in place by mast brackets.

The rail and carrier are made of strong, lightweight materials. This reduces shipping costs and makes the device easier to install. In the preferred embodiment, the rail is made of square tube aluminum 6 inches by 6 inches (15.24 cm×15.24 cm) type 6061 aluminum. The rail is divided into sections. At a minimum, there are a 10-foot (3.048 meter) base unit 2*a* and a 10-foot (3.048 meter) cap unit 2*b*. Thus, the minimum height of the device is 20 feet (6.096 meters). The device can be lengthened by adding 10-foot (3.048 meter) extension sections. The maximum height of the unit is 150 feet (45.72 meters) using the type 6061 aluminum. It is possible, of course, to use different materials if greater heights are needed.

The carrier 4 is made of 7 inch×7-inch (17.78×17.78 cm) 6061 square tube aluminum. In the preferred embodiment, the carrier is 4 feet (1.2 meters) long. It is designed for a load capacity of 50 pounds (22.7 kg). The steel mast 5 is typically made of 1 to 2 inch (2.54-5.08 cm) diameter steel pipe. Normally, the mast extends up to 10 feet (3.0 meters) above the carrier.

Figure 2:
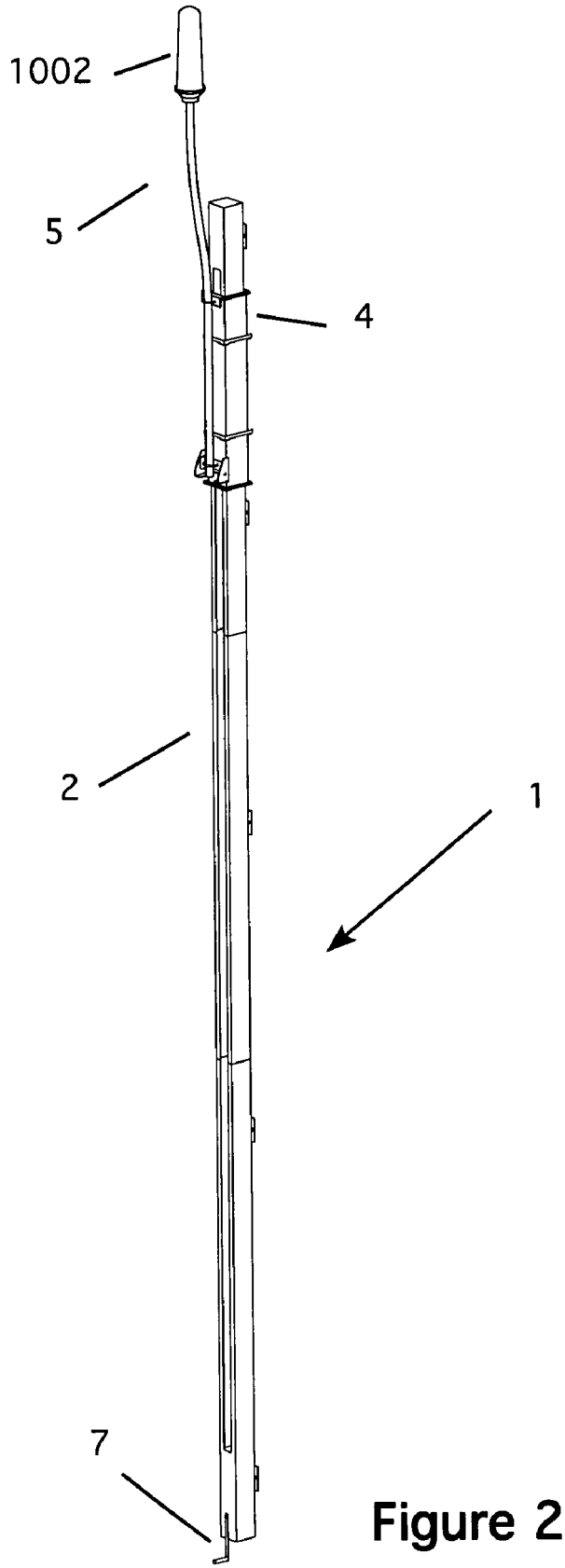
FIG. 2 is a perspective view of the invention with the antenna carrier raised.

FIG. 2 is a perspective view of the invention with the antenna carrier raised. Here, the main components: the rails, 2, the carrier 4, and the mast 5 are all shown. In addition, the mast 5 has a type of antenna 1002 attached. At the bottom of the rail is a crank 7 for a manual winch. In the preferred embodiment, the winch has a 4:1 gear ratio. This makes raising the carrier sufficiently easy for an average worker. As discussed below, an optional electric drill motor can drive the winch as well.

Figure 3:
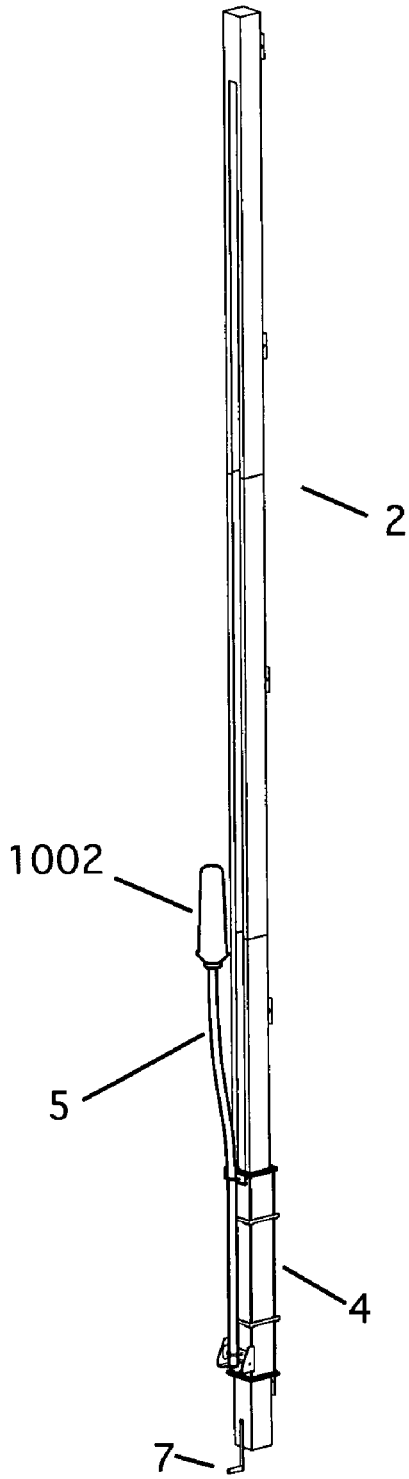
FIG. 3 is a perspective view of the invention with the antenna carrier lowered.

FIG. 3 is a perspective view of the invention with the antenna carrier lowered. Here, the carrier 4 is positioned at the bottom of the rail 2. The bottom carrier is now at the level of a worker's waist. While this provides better access to the antenna, it requires a ladder to reach the top of the mast.

Figure 4:
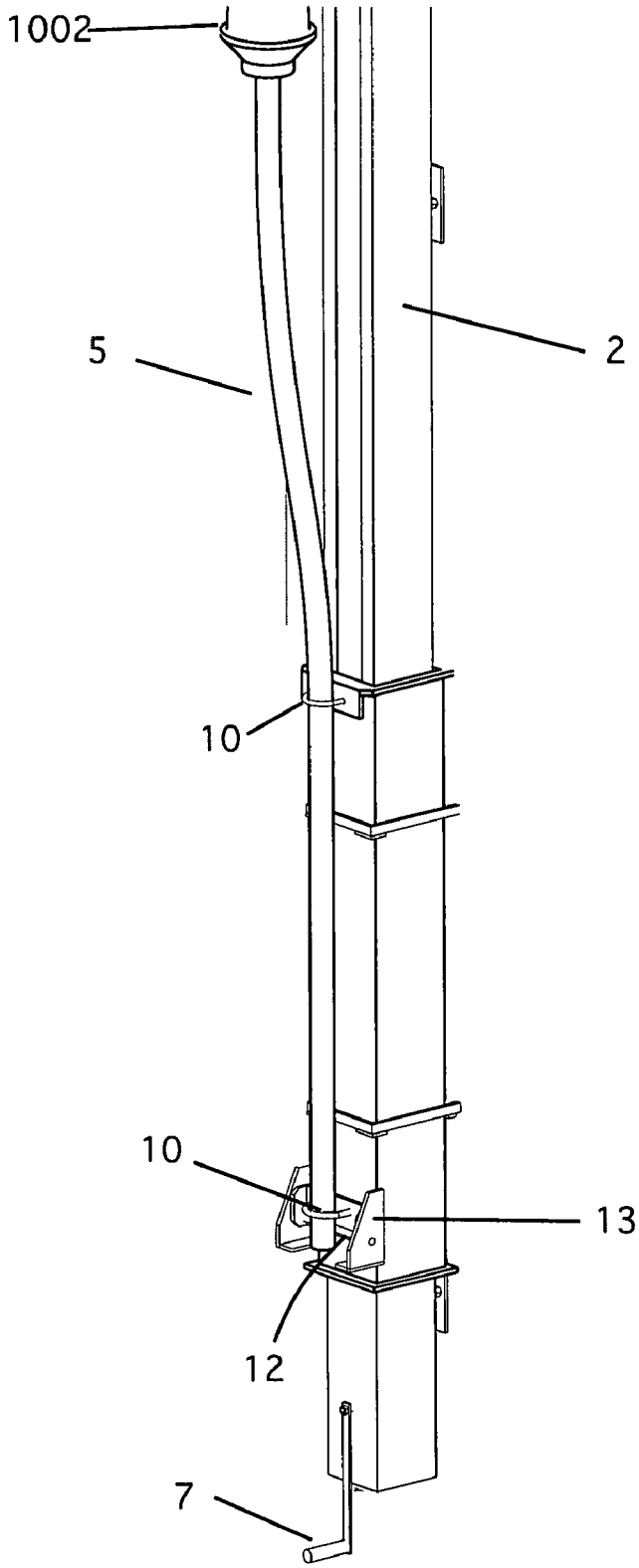
FIG. 4 is detail view of the antenna carrier in the lowered position.

FIG. 4 is detail view of the antenna carrier in the lowered position. Here, the problem of antenna access is solved. This view shows details of the mast attachment system. The mast 5 is secured to the carrier 4 by "U" brackets 10. In addition, the bottom of the mast is secured by a bolt 12 and nut 12*a* (see FIG. 12) through a carrier pivot bracket 13. Once the top "U" brackets are removed, the mast can be pivoted into a horizontal position as shown in FIG. 5.

Figure 5:
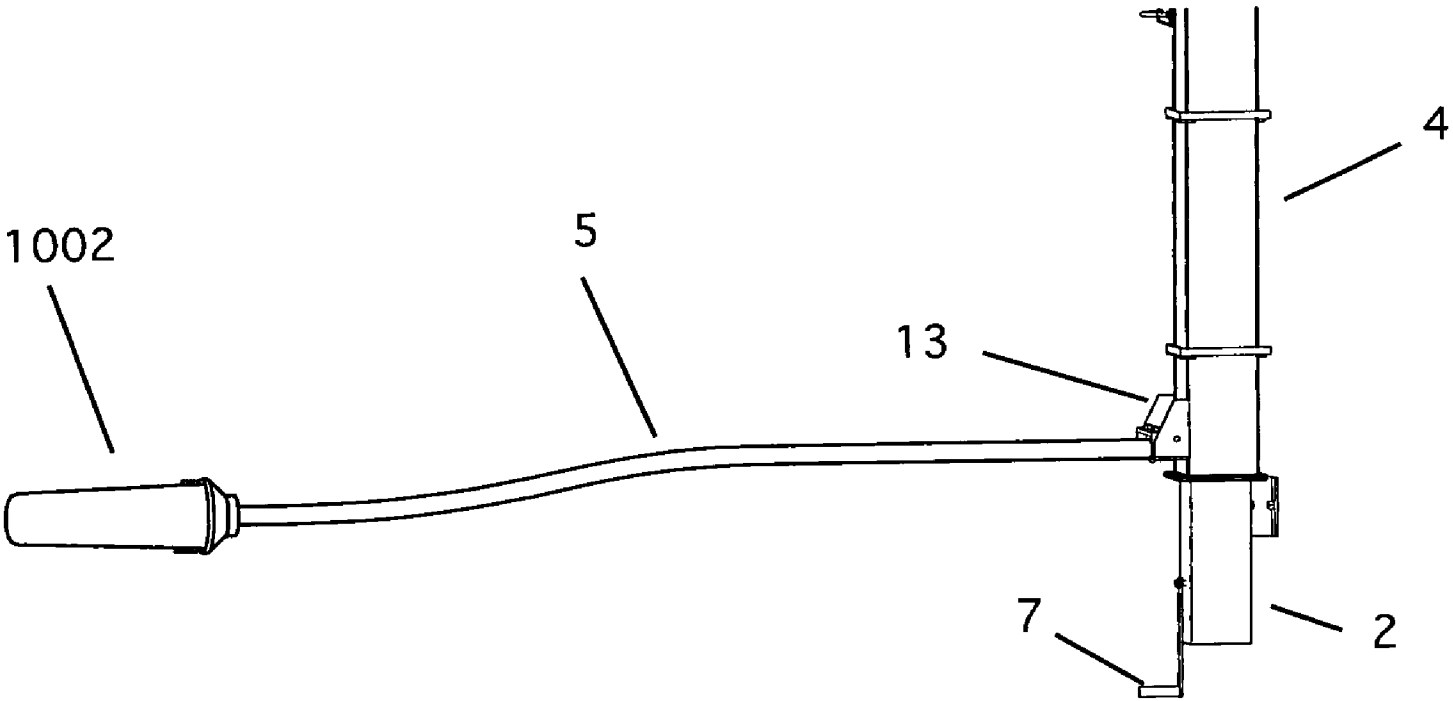
FIG. 5 is a detail of the antenna carrier in the lowered position with the antenna in the rotated position.

FIG. 5 is a detail of the antenna carrier 4 in the lowered position with the mast 5 and antenna 1002 in a rotated position for easy access. In this position, workers have complete access to the antenna 1002 with no need for ladders.

Thus, using this system makes servicing an antenna simple and easy: a worker simply arrives on site, cranks down the carrier to the bottom of the rail, releases the mast, pivots the mast and in a few minutes has full access to the antenna for service. When service is complete, the works rotates the mast into the vertical position, restores the top clamp, and raises the carrier into the operating position.

Figure 6:
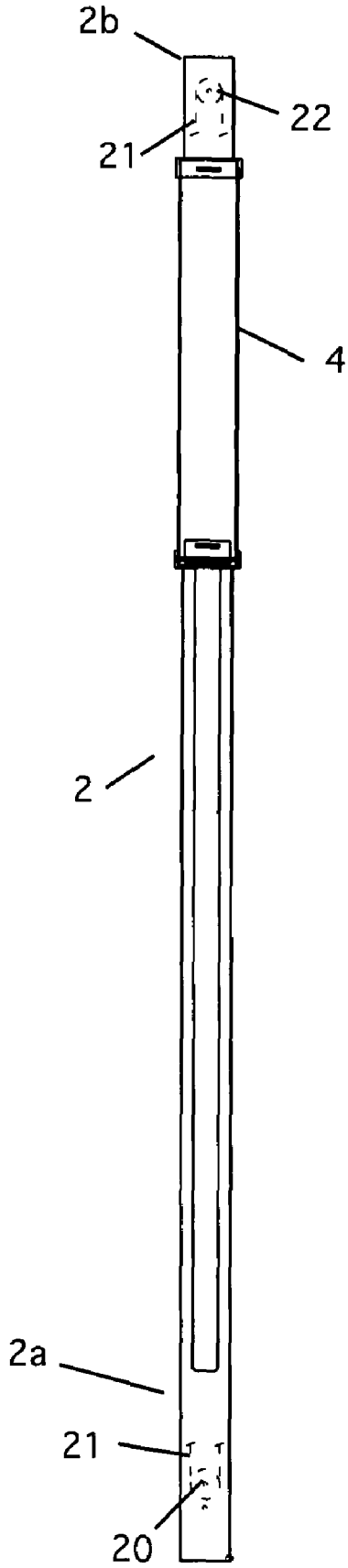
FIG. 6 is a front view of the rail with the antenna carrier in the raised position

FIG. 6 is a front view of the rail with the antenna carrier in the raised position showing the placement of the drive sprockets for the winch. Here, the rail 2 and carrier 4 are shown in the basic configuration of a base section and a cap unit. At the bottom 2*a* of the base unit is a sprocket 20 that has a length of chain 21 wrapped around it. At the top 2*b* of the cap unit is a sheave 22 that has a cable 21 wrapped around it. The chain moves about the sprocket as the winch crank is turned. As discussed below, the chain is attached to a cable (see FIG. 14), which attaches to the top of the carrier. The cable is pulled by the chain through the sheave to raise the carrier. The chain is connected directly to the carrier at its base to pull the carrier down the rail. A chain can be used over the entire length (with a sprocket at the top), but this option adds weight and cost. A complete run of cable can also work, but requires some type of capstan at the base to provide enough friction to allow the carrier to be raised. The preferred embodiment uses the chain-cable combination because it is the most cost effective and lightweight option that ensures proper operation of the system. The carrier fits sufficiently tight to the rail such that if the cable should break, the carrier will not fall. This adds an additional safety factor. Obviously, when extension sections are added to the unit, the chain and cable must be lengthened accordingly.

Figure 7:
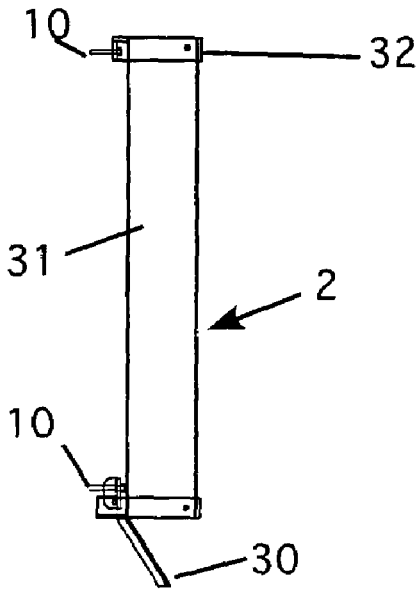
FIG. 7 is a right side view of the antenna carrier.

FIG. 7 is a right side view of the antenna carrier. At the bottom of the carrier 4 is a bracket 10, as discussed above. Attached below that is a cable guide 30 that feeds the antenna cable safely along the rail. The carrier body is made of aluminum tubing panels 31 and is capped off on the top by a carrier stiffener plate 32.

Figure 8:
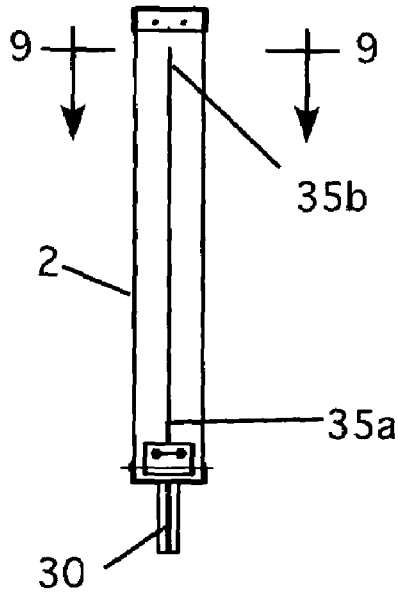
FIG. 8 is a front view of the antenna carrier.

FIG. 8 is a front view of the antenna carrier. Here, the chain link connection 35*a* is shown at the base of the carrier. Also at the top of the carrier is the cable fork connection 35*b*.

Figure 9:
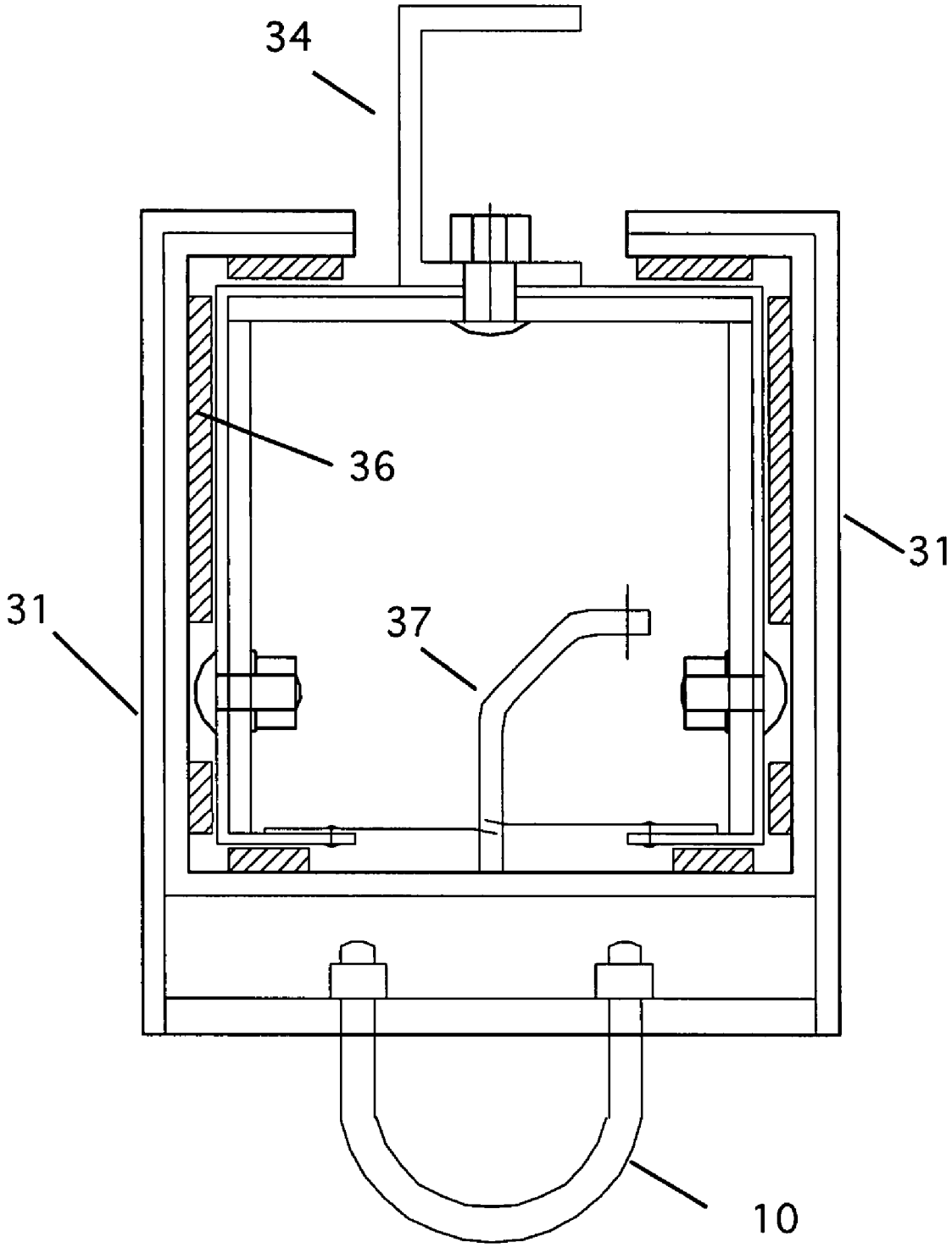
FIG. 9 is a cross-sectional view of the antenna carrier taken along the lines 9-9 of FIG. 8.

FIG. 9 is a cross-sectional view of the antenna carrier taken along the lines 9-9 of FIG. 8. Here, the stainless steel U-type pipe clamp 10 is shown at the bottom of the carrier. The aluminum tubing pieces that make up the outer walls of the carrier are also shown. At the top of the figure is column support bracket 34 that is used to attach rail to existing structure.

In the center of the carrier is a lift bracket 36. This bracket is used to attach the cable to lift and lower the carrier. The inside walls of the carrier are lined with ultra High Molecular weight (UHMW) pads 37 that provide a snug fit for the carrier, while providing some cushioning for it as it moves up and down the rails.

Figure 10:
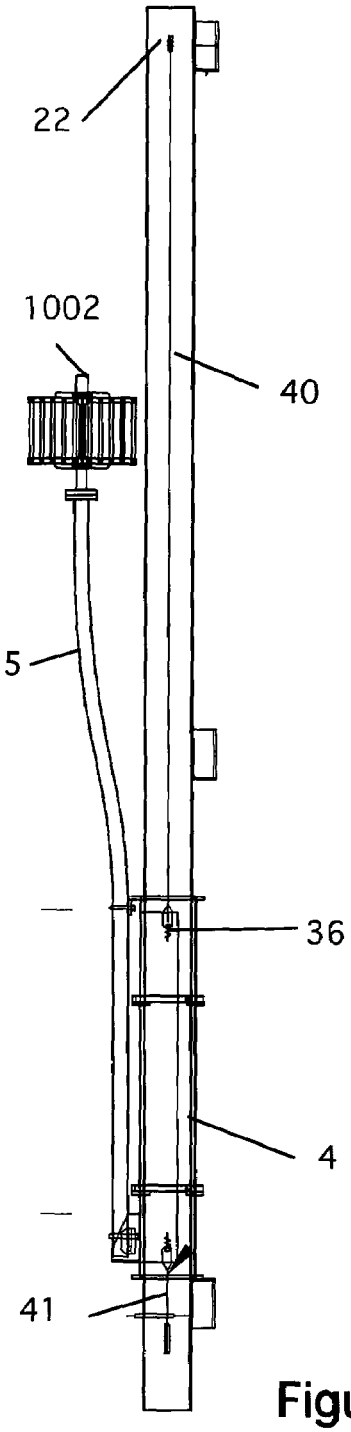
FIG. 10 is a side view of the rail and antenna carrier in the lowered position, showing the placement of the operating cables.

FIG. 10 is a side view of the rail and antenna carrier in the lowered position, showing the placement of the operating cables. In this view, the carrier 4, with an antenna in place, is shown at the bottom of the rail. The carrier has a cable bracket 36 to which a cable 40 attached. The cable then rises to the upper sheave 22. It descends to a chain link and cable eye (see FIG. 14) and the chain 41 descends to the lower sprocket 20 located in the bottom of the rail. The chain 41 then returns up the base of the carrier, where it attaches to a chain link connector 40*b*.

Figure 11:
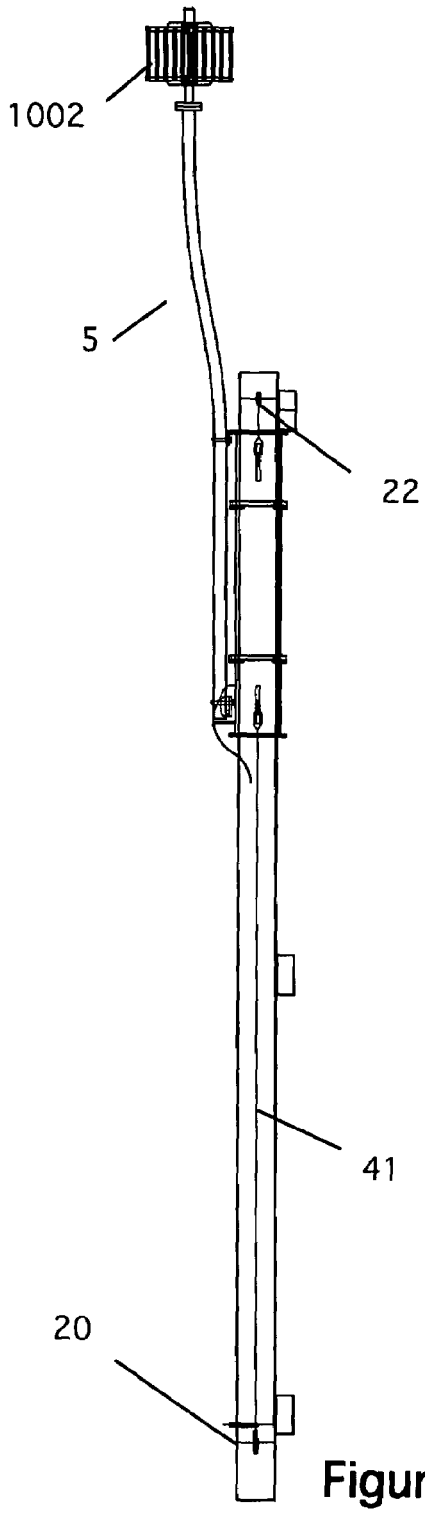
FIG. 11 is a side view of the rail and antenna carrier in the raised position, showing the placement of the operating cables.

FIG. 11 is a side view of the rail and antenna carrier in the raised position, showing the placement of the operating cables. In this view, the carrier 4, with an antenna in place, is shown at the top of the rail. The carrier has a cable bracket 36 to which a cable 40 is attached. The cable then rises to the upper sheave 22. It descends to a chain link and cable eye 58 (see FIG. 14) and the chain descends to the lower sprocket 20 located in the bottom of the rail. The chain then returns up to the base of the carrier, where it attaches to a chain link connector 40*b* and 59.

In this way, the carrier can be raised or lowered by simply turning the crank at the bottom of the rail.

Figure 12:
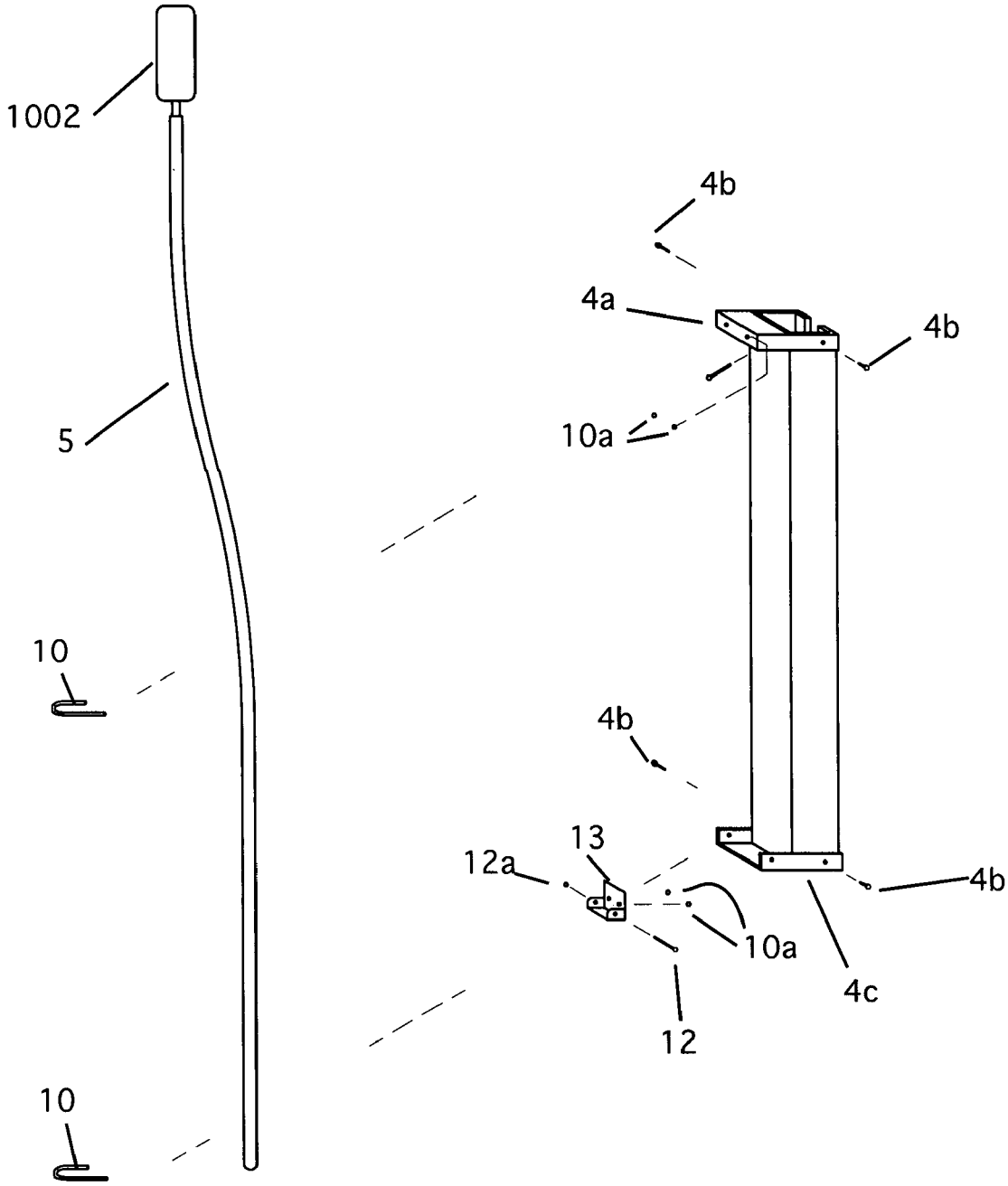
FIG. 12 is an exploded detail view of the antenna mast and carrier.

FIG. 12 is an exploded detail view of the antenna mast and carrier. In this view, the mast 5 is shown with an antenna 1002. The carrier 4 is shown with an upper support bracket 4*a* that is secured to the top of the carrier with welds. The lower bracket 4*c* is also secured by welds. Fasteners 4*b* provide friction to the rail. The upper bracket has holes to attach the top "U" bolt 10 using nuts 10*a*. The bottom of the mast is secured by a bolt 12 and nut 12*a* through a carrier pivot bracket 13. The carrier pivot bracket 13 also has holes to accept the lower "U" bolt 10 with nuts 10*a*.

FIG. 5 is a detail of the antenna carrier 4 in the lowered position with the mast 5 and antenna 1002 in a rotated position for easy access. In this position, workers have complete access to the antenna 1002 with no need for ladders.

Figure 13:
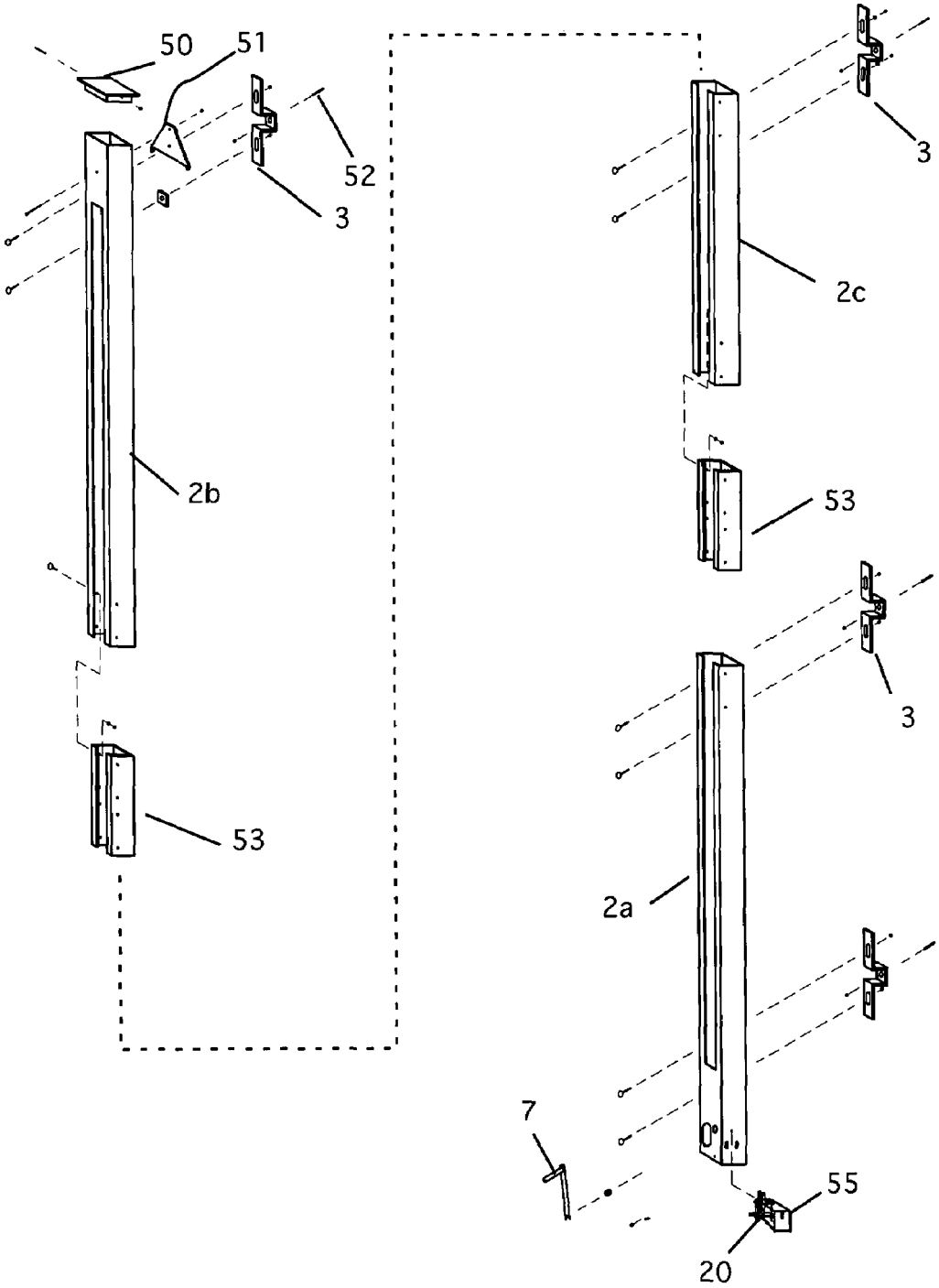
FIG. 13 is an exploded detail view of the rail system.

FIG. 13 is an exploded detail view of the rail system. As noted above, the rail system has a base unit 2*a* and a cap unit 2*b*. The device can be lengthened by adding 10-foot (3.0 meter) extension sections 2*c*. In this view, a top cap 50 is shown. The top cap 50 is positioned in the top of the cap unit 2*b* and is secured with appropriate fasteners. As noted, several brackets 3 are used to attach the rails to the desired structure. At the uppermost bracket, a stop bracket 51. This bracket is used to ensure the carrier does not rise too high on the rail. All of the brackets are secured using appropriate fasteners 52 and washers. The main sections are joined using joiner sections 53. The joiner sections attach to the main sections using appropriate fasteners.

At the bottom of the base section, the winch crank handle 7 is shown being attached to the lower sprocket 20 and its support bracket 55.

In this figure, a cap section, an intermediate section and a base section are joined using joiner sections. Several additional intermediate sections 2*c* can be added as needed by using jointer sections and brackets, in the same manner discussed above.

Figure 14:
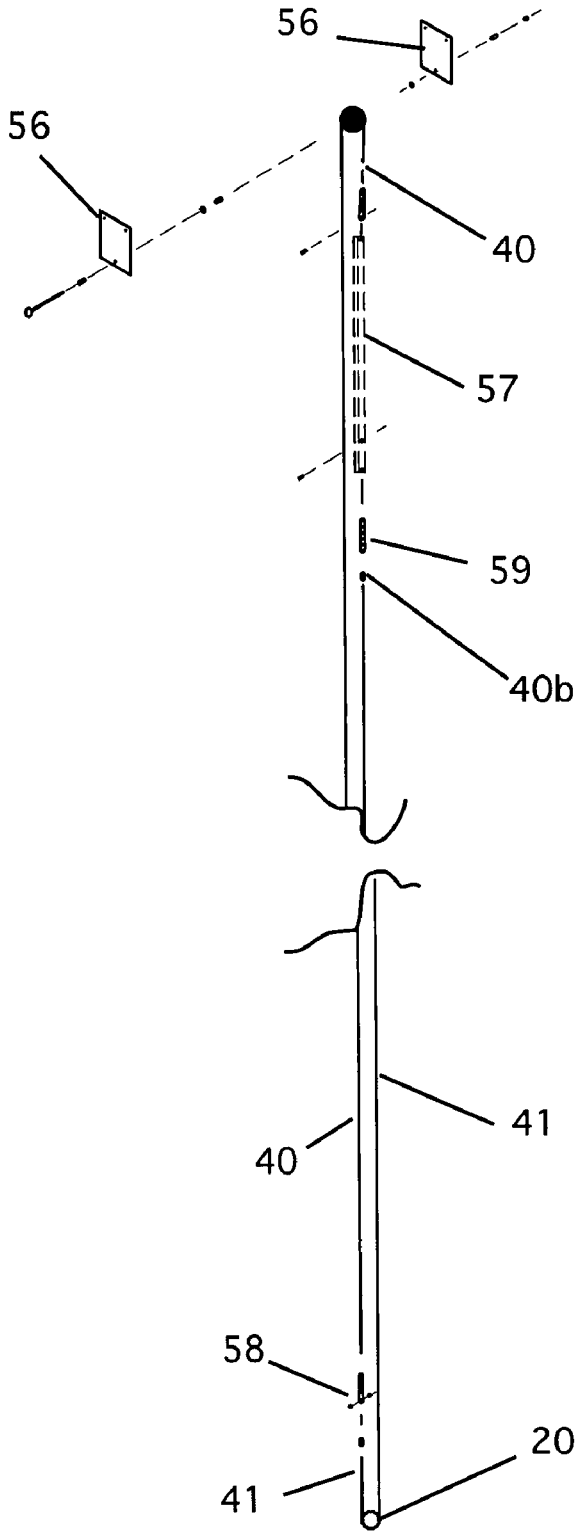
FIG. 14 is an exploded detail view of the cable and chain assembly.

FIG. 14 is an exploded detail view of the cable and chain assembly. As discussed above, the system, in the preferred embodiment, uses a combination of chain and cable to raise and lower the carrier. This combination is preferred because it produces a lightweight, efficient and safe means for operating the carrier. This figure shows details of the chain and cable assembly. At the top of the figure is the cable sheave 22. Two guide plates 56 are positioned inside the rail around the sheave to help guide the cable through the sheave. The cable 40 passes over the top of the sheave and extends down to a stainless steel attachment, where it attaches to a strut 57 installed in the carrier. At the bottom of the strut 57 is a link 40*b* and a link extender 59 that attaches to the chain 41. The chain 41 descends to the sprocket 20. It passes under the sprocket 20 and rises on the other side where it attaches to a cable eye 58. The cable then rises back up the top sheave 22. In the preferred embodiment, both the cable and chain are made of stainless steel, as are the connection fittings.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A wall-mounted antenna rail mast system comprising:

a) a rail, having a top and a bottom, said rail being positioned vertically;

b) a carrier, slidably attached to said rail;

c) a means for supporting an antenna, attached to said carrier; and d) a means for raising and lowering said carrier on said rail.

2. The wall-mounted antenna rail mast system of claim 1 wherein the means for raising and lowering said carrier on said rail include: a winch, operably attached to said rail and in operable communication with said carrier.

3. The wall-mounted antenna rail mast system of claim 1 wherein the means for raising and lowering said carrier on said rail are operably installed in said rail.

4. The wall-mounted antenna rail mast system of claim 1 wherein the rail is attached to a pre-existing standing structure.

5. The wall-mounted antenna rail mast system of claim 4 wherein the pre-existing standing structure is selected from the group of: a building wall surface, a pole and a tower.

6. The wall-mounted antenna rail mast system of claim 1 wherein the means for supporting an antenna further comprise a means for reversibly tilting the antenna from a vertical position to a horizontal position.

7. The wall-mounted antenna rail mast system of claim 1 wherein the means for supporting an antenna include an antenna mast.

8. The wall-mounted antenna rail mast system of claim 7 wherein the means for reversibly tilting the antenna from a vertical position to a horizontal position include:

a) a bracket installed at the bottom of said carrier; and b) a pivoting means, installed in said bracket and being operably installed in said antenna mast.

9. A wall-mounted antenna rail mast system comprising:

a) a rail, having a top and a bottom;

b) a means for attaching said rail to a pre-existing structure in a vertical orientation;

c) a carrier, slidably attached to said rail, said carrier having a top and a bottom;

d) a means for supporting an antenna, attached to said carrier; and e) a means for raising and lowering said carrier on said rail.

10. The wall-mounted antenna rail mast system of claim 9 wherein the means for raising and lowering said carrier on said rail include: a winch, operably attached to a sprocket, operably installed in said rail.

11. The wall-mounted antenna rail mast system of claim 9 wherein the means for raising and lowering said carrier on said rail are operably installed in said rail.

12. The wall-mounted antenna rail mast system of claim 9 wherein the means for attaching said rail to an existing structure comprise a plurality of support brackets.

13. The wall-mounted antenna rail mast system of claim 9 wherein the pre-existing standing structure is selected from the group of: a building wall surface, a pole and a tower.

14. The wall-mounted antenna rail mast system of claim 9 wherein the means for supporting an antenna further comprise a means for reversibly tilting the antenna from a vertical position to a horizontal position.

15. A wall-mounted antenna rail mast system comprising:

a) a rail, having a top and a bottom;

b) a means for attaching said rail to a pre-existing structure;

c) a carrier, slidably attached to said rail, said carrier having a top and a bottom;

d) a means for supporting an antenna, attached to said carrier; and e) a means for raising and lowering said carrier on said rail including:

i) a sprocket, installed in said bottom of said rail;

ii) a sheave, installed in said top of said rail;

iii) a length of chain, having a first end and a second end, being positioned around said sprocket and extend upwardly therefrom, wherein said first end of said chain is attached to the bottom of said carrier;

iv) a length of cable having a first end and a second end, being positioned around said sheave and extend downwardly therefrom, wherein said first end of said cable is attached to the top of said carrier; and v) wherein said second end of said chain is attached to said second end of said cable.

16. The wall-mounted antenna rail mast system of claim 15 further including at least one intermediate section positioned between said rail top and bottom, installed in said rail.

17. The wall-mounted antenna rail mast system of claim 15 wherein the means for attaching said rail to an existing structure comprise a plurality of support brackets.

18. The wall-mounted antenna rail mast system of claim 15 wherein the pre-existing standing structure is selected from the group of: a building wall surface, a pole and a tower.

19. The wall-mounted antenna rail mast system of claim 15 wherein the means for supporting an antenna further comprise a means for reversibly tilting the antenna from a vertical position to a horizontal position.

* * * * *